US007568640B2

(12) United States Patent
Rademacher

(10) Patent No.: US 7,568,640 B2
(45) Date of Patent: Aug. 4, 2009

(54) METHOD AND APPARATUS FOR REMOVAL OF GUTTER DEBRIS

(76) Inventor: George Rademacher, 221 Park Ave., Pittsburgh, PA (US) 15229

( * ) Notice: Subject to any disclaimer, the term of this patent is extended or adjusted under 35 U.S.C. 154(b) by 0 days.

(21) Appl. No.: 11/811,512

(22) Filed: Jun. 11, 2007

(65) Prior Publication Data

US 2008/0066391 A1 Mar. 20, 2008

Related U.S. Application Data

(60) Provisional application No. 60/835,223, filed on Aug. 3, 2006.

(51) Int. Cl.
*B02C 23/36* (2006.01)

(52) U.S. Cl. ..... 241/21; 241/282.2

(58) Field of Classification Search ..... 241/277, 241/282.1, 282.2, 21; 15/383; 52/11–16
See application file for complete search history.

(56) References Cited

U.S. PATENT DOCUMENTS 2,121,613 A 6/1938 Schultz
4,168,559 A * 9/1979 Henson ..... 15/23
4,241,547 A 12/1980 Bove'
4,602,460 A * 7/1986 Langenbach ..... 52/1
4,718,613 A * 1/1988 Moomaw ..... 241/60
4,807,406 A 2/1989 Densmore
4,837,987 A 6/1989 Fender
5,302,283 A 4/1994 Meuche
5,727,350 A 3/1998 Marcella
5,802,775 A 9/1998 Toth
6,598,352 B2 7/2003 Higginbotham
6,926,210 B2 8/2005 Baxter
7,174,676 B1 * 2/2007 Armstrong ..... 52/11

* cited by examiner

*Primary Examiner*—Mark Rosenbaum
(74) *Attorney, Agent, or Firm*—David G. Oberdick; Meyer, Unkovic & Scott LLP

(57) ABSTRACT

A debris removal apparatus for use in a gutter having a mounting plate with a hole defined therein, attached to the top of a gutter, a power source situated near the top of the mounting plate, a shaft, having a first end and a second end, and wherein the shaft is attached to the power source at the first end. The shaft extends through the hole defined in the mounting plate. Also provided is a hub attached to a second end of the shaft having a plurality of spokes or blades extending therefrom, whereby the spokes or blades are adapted to remove debris from the gutter to prevent clogging and flooding. Further provided is a method of using the debris removal apparatus to maintain a debris-less gutter on a structure.

19 Claims, 14 Drawing Sheets

METHOD AND APPARATUS FOR REMOVAL OF GUTTER DEBRIS

PRIORITY

This application hereby claims priority to provisional application Ser. No. 60/835,223, filed on Aug. 3, 2006.

FIELD OF THE INVENTION

This invention relates generally to a method and apparatus for removing debris located in gutters and more particularly relates to an apparatus and method for the removal of debris accumulation in gutters using an apparatus having a plurality of spokes and/or blades for debris elimination.

BACKGROUND OF THE INVENTION

Debris accumulation in gutters is a constant problem for building owners, especially building owners with trees above or around their home. In the fall and spring of the year, especially in the Northern regions of the United States, trees lose their leaves and/or shed buds or flowers. These leaves, buds and flowers end up on roofs and ultimately in gutters on structures, homes or buildings. This debris clogs gutters and downspouts, especially at the connection between the gutter and the downspout. This clogging can cause a multitude of problems including gutters becoming detached from the structure, flooding around the structure and damage to roofs and shingles.

Some patents have attempted to solve this ongoing problem by various methods, none of which fully eliminate the problem.

U.S. Pat. No. 5,802,775, for example, teaches a flexible cage that is placed into a gutter downspout opening where the gutter meets the downspout. A cord is attached at the top center of the flexible cage. It extends through the cage and out of the downspout. The invention has a plurality of hubs. When the cord is pulled by a user, the device rotates within a downspout and attempts to clear debris from the downspout opening. The device also acts as a passive debris restrainer for the top of a downspout. One disadvantage of this invention is that a user must pull the cord to effectuate the rotation and in turn the debris cleaning.

Another related patent, U.S. Pat. No. 4,241,547, discloses a rainwater ducting system wherein an auger-like device is situated in a gutter lengthwise to advance debris towards the downspout. The invention also encompasses another auger-like device in a downspout to advance debris downward after it enters the downspout. One of the disadvantages of this invention is that it is quite expensive to manufacture and install. Additionally, the device can easily clog with debris and become more of a problem than a help. Further, the invention places a great deal of weight on the gutters and/or downspout of a structure potentially causing both to separate from the structure.

Meuche, U.S. Pat. No. 5,302,283, discloses a leaf guard and strainer assembly for a gutter downspout of a structure. This invention has strainer type device that prevents debris from entering the downspout. However, this invention does not provide any means of clearing debris from the outside of the strainer device and therefore clogging eventually occurs. When the clogging occurs, the building owner has to physically climb up on the roof and clean the debris from the outside of the strainer device. This is not desirable for the building owner.

The debris removal apparatus of the present invention overcomes the disadvantages of the related technologies as discussed below.

SUMMARY OF THE INVENTION

An object of the present invention is to remove debris from a gutter using a hub assembly with a plurality of spokes or blades attached thereto.

Another object of the present invention is to prevent flooding and/or clogging in gutters.

Another object of the present invention is to prevent flooding around structures caused by clogged gutters.

Yet another object of the present invention is to provide a rain sensing means which activates the debris removal apparatus during rain storms.

Yet another object of the present invention is to provide a debris removal apparatus that can be powered by solar energy.

Yet another objection of the present invention is to provide a debris deflector to prevent clogging in a downspout or sewer.

Therefore, what is provided is a debris removal apparatus for a gutter having a mounting plate having a hole defined therein, capable of attachment to a top of a gutter, a power source attached to a top of the mounting plate, a shaft, having a first end and a second end, attached to the power source at a first end, wherein the shaft extends through the hole defined in the mounting plate and a hub attached to a second end of the shaft having a plurality of spokes or blades extending therefrom, whereby the spokes are adapted to remove large debris from the gutter to prevent clogging and flooding.

A locking nut optionally can be placed on the shaft between the mounting plate and the hub to provide support to the debris removal apparatus. The spokes of the apparatus are optionally of varying length and extend outwardly and downwardly from the hub.

The apparatus attaches to a gutter by means of a bracket and a bar, each with holes defined therein for accepting pins. The bracket and bar are specifically for attachment of the mounting plate to the gutter. The apparatus further comprises a rain sensor and water director to activate the power source during rain storms or when needed. Also provided is an optional cover which is placed over the debris removal apparatus to protect it from weathering.

Further provided herein is a method of debris removal from a gutter comprising the steps of: mounting a debris removal apparatus in a gutter above or near a downspout opening, using the power source to rotate a shaft and in turn a hub and spokes or blades and chopping debris in a gutter using the spokes or blades to provide debris-less gutters on a structure. The method further comprises the step of using a rain sensor and a water director to activate a power source on the debris removal apparatus during rain storms.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated apparatus and method, and such further applications of the principles of the invention illustrated herein, as would normally occur to persons skilled in the art to which the invention relates.

Figure 11:
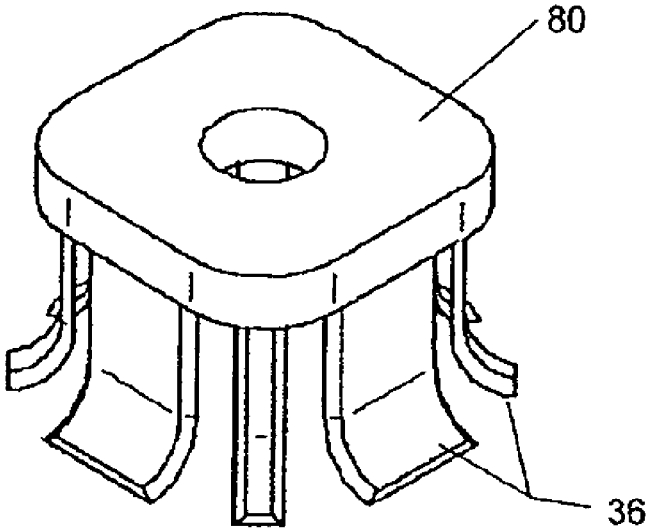
FIG. 11 is another preferred embodiment of the hub assembly of the present invention, using blades instead of spokes.
Figure 12:
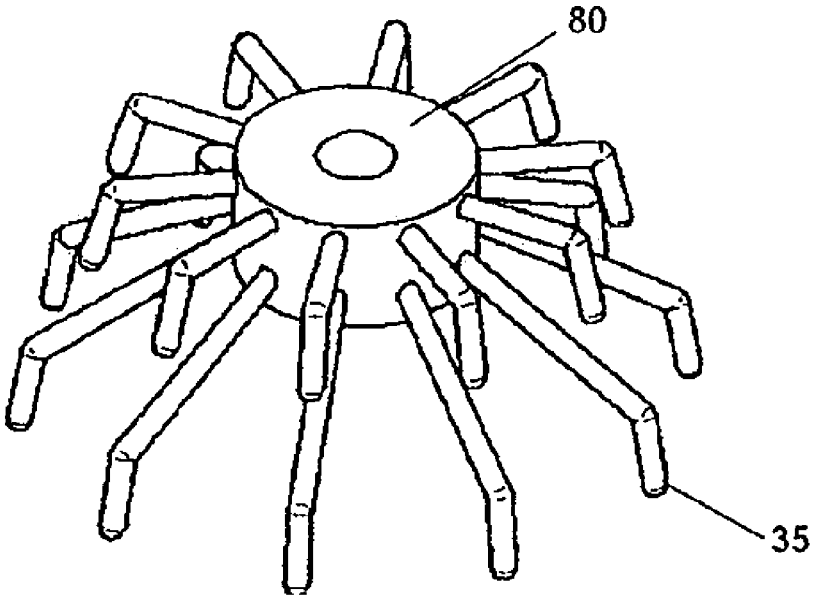
FIG. 12 is another embodiment of the hub and spoke assembly of the present invention.
Figure 13:
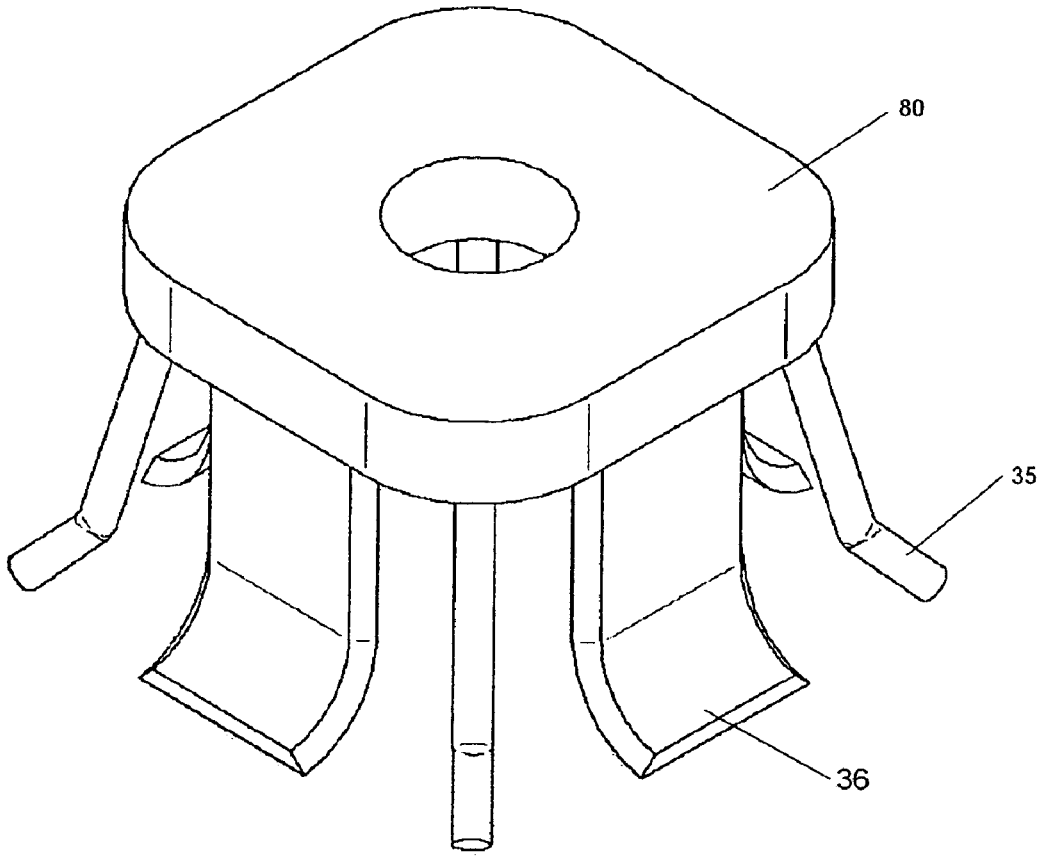
FIG. 13 is another embodiment of the hub assembly of the present invention using blades and spokes.

Referring now to FIGS. 1-16, the debris removal apparatus 10 has a hub 80 with a plurality of spokes 35 and/or blades 36 extending therefrom. In a preferred embodiment, the spokes 35, are of varying length to achieve maximum debris removal. A hub 80 with a plurality of spokes 35 and/or blades 36 of similar length is also within the scope of this invention. The spokes optionally can be partially or fully comprised of blades 36 and/or other cutting means used to chop heavier debris such as twigs, branches and/or leaf stems (see FIGS. 11 and 13, specifically no. 36).

The spokes 35 and/or blades 36 are made of plastic, metal, rubber or any other similar material known to those skilled in the art. The spokes 35 and/or blades 36 are attached to the hub 80 by any means known in the art. In the preferred embodiment, the spokes 35 and/or blades 36 are placed around the circumference of the hub 80 in order to provide maximum debris removal. Preferably, the spokes 35 and/or blades 36 extend outwardly and/or downwardly from the hub 80, but can extend in any other direction and still be within the scope of the present invention. A hub 80 with spokes 35 and/or blades 36 only around part of the circumference of the hub 80 is also within the scope of this invention.

A shaft 50 has a first end and a second end. The hub 80 is attached to the shaft 50 at its second end, while connected to a power source 15, at its first end. The power source 15 rotates the shaft 50, causing the hub 80 and in turn, the plurality of spokes 35 and/or blades 36 to rotate in unison, creating a debris break up and removal action (see FIG. 3). The shaft 50 is optionally threaded to enable the hub 80 to screw thereon as a means of attachment. In one various embodiment, one or two locking nuts 55 are threaded onto the shaft 50 in between the mounting plate 100 and the hub 80 to tightly secure the shaft 50 to the mounting plate 100. The locking nuts 55 are located on the shaft 50 directly below the mounting plate 100. An optional washer can be used to space the locking nuts 55 from the bottom side of the mounting plate 100. If a non-threaded shaft 50 is used any connection means known in the art can be applied to attach the hub 80 to the shaft 50.

Figure 1:
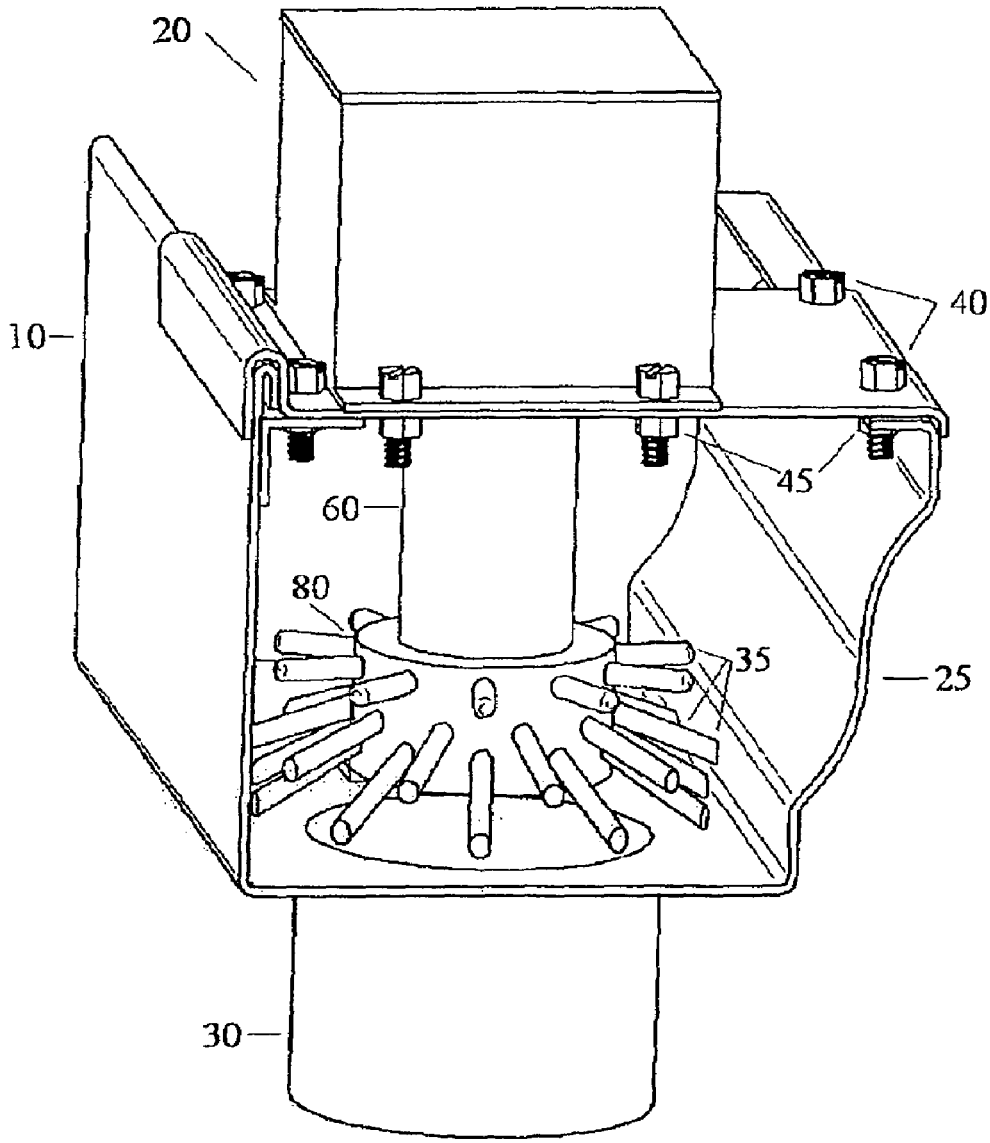
FIG. 1 is a perspective view of the debris removal apparatus of the present invention.
Figure 2:
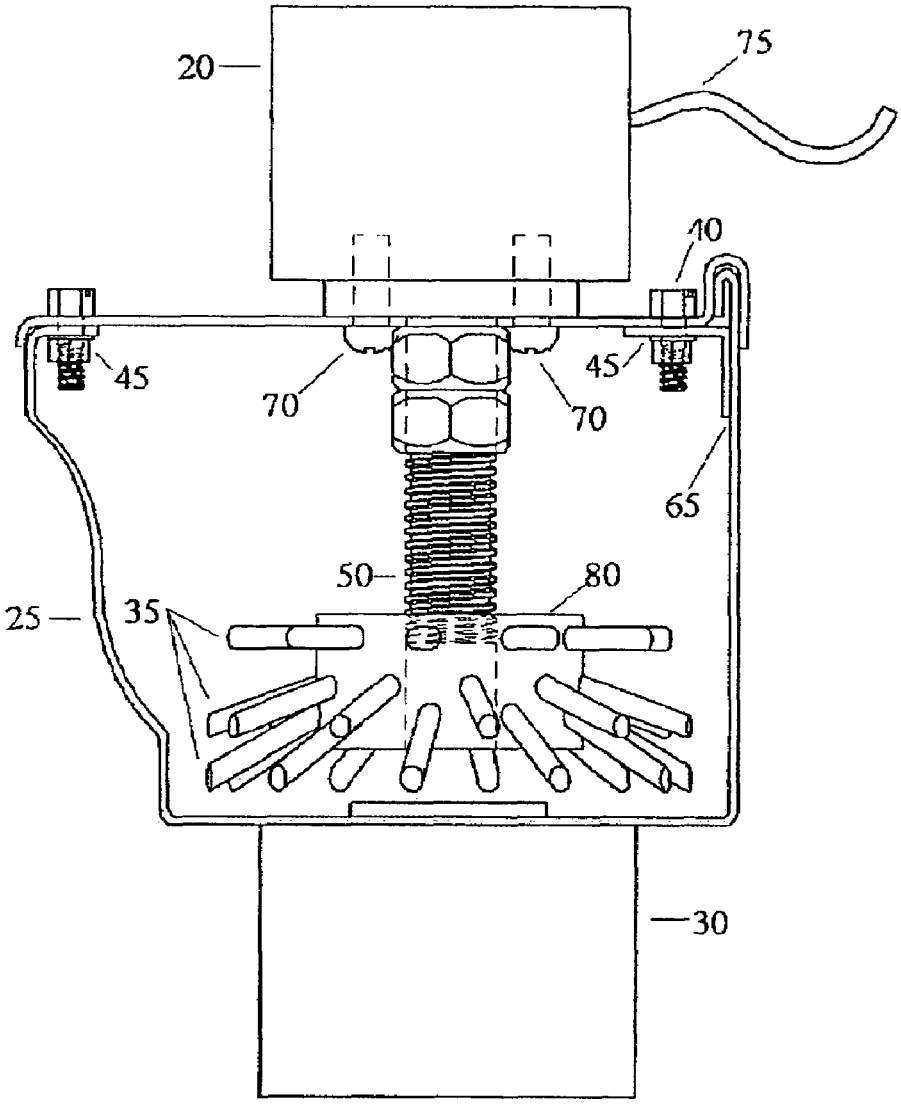
FIG. 2 is a side view of the debris removal apparatus of the present invention.
Figure 3:
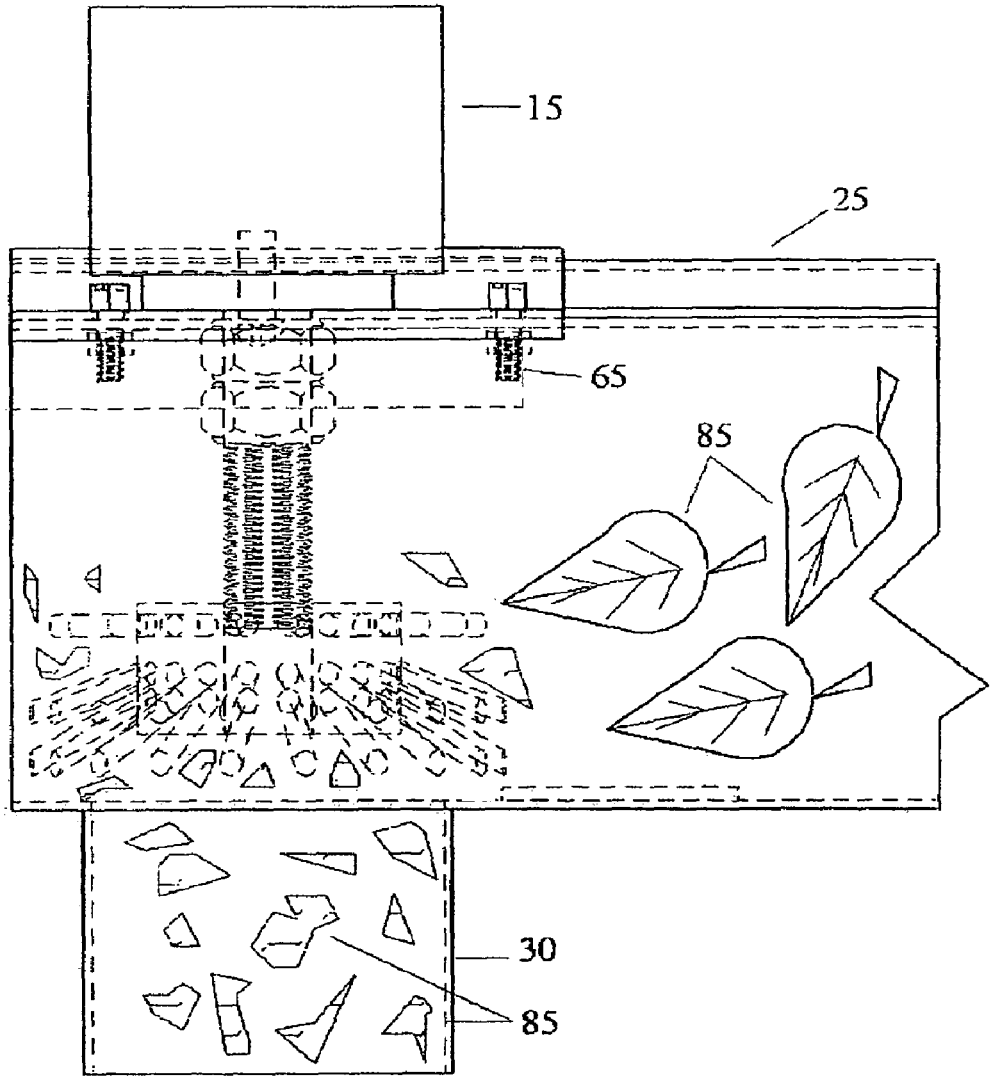
FIG. 3 is rear view of the debris removal apparatus of the present invention.
Figure 4:
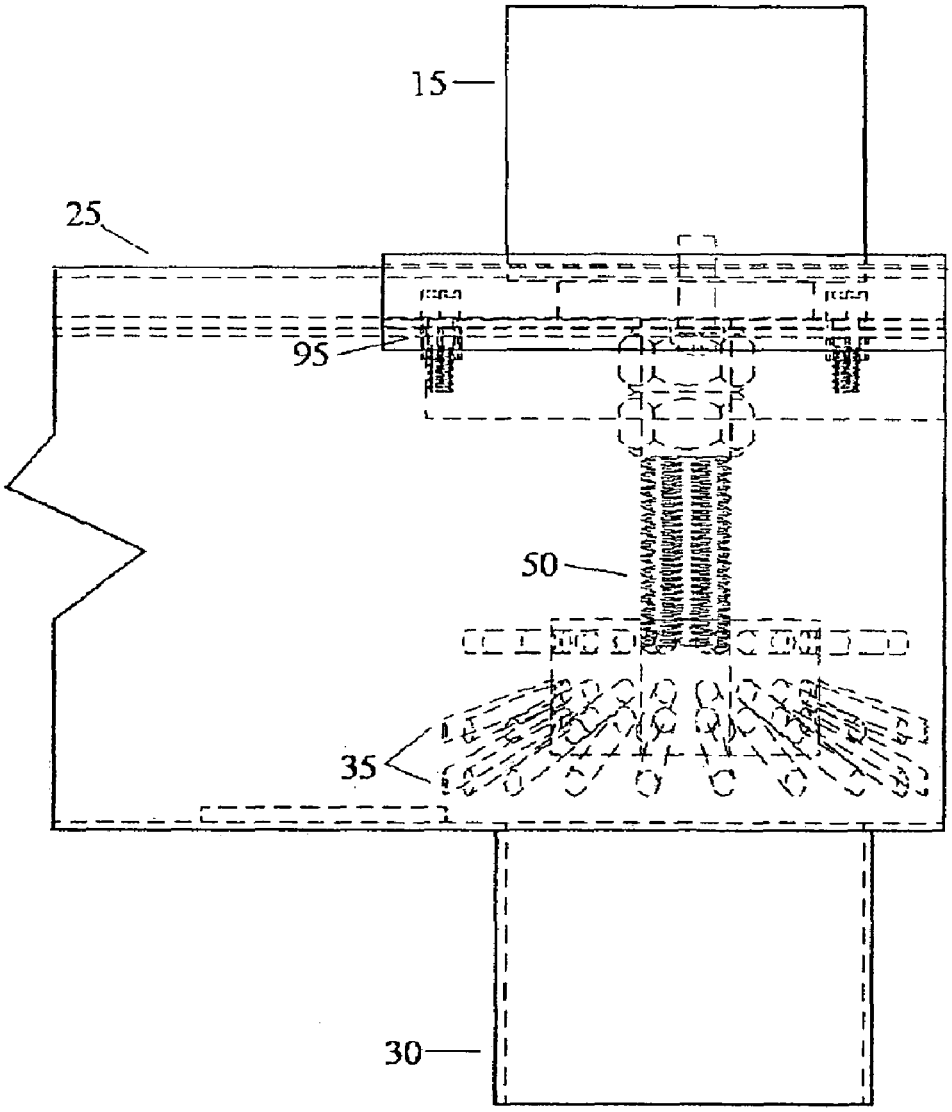
FIG. 4 is a front view of the debris removal apparatus of the present invention.
Figure 5:
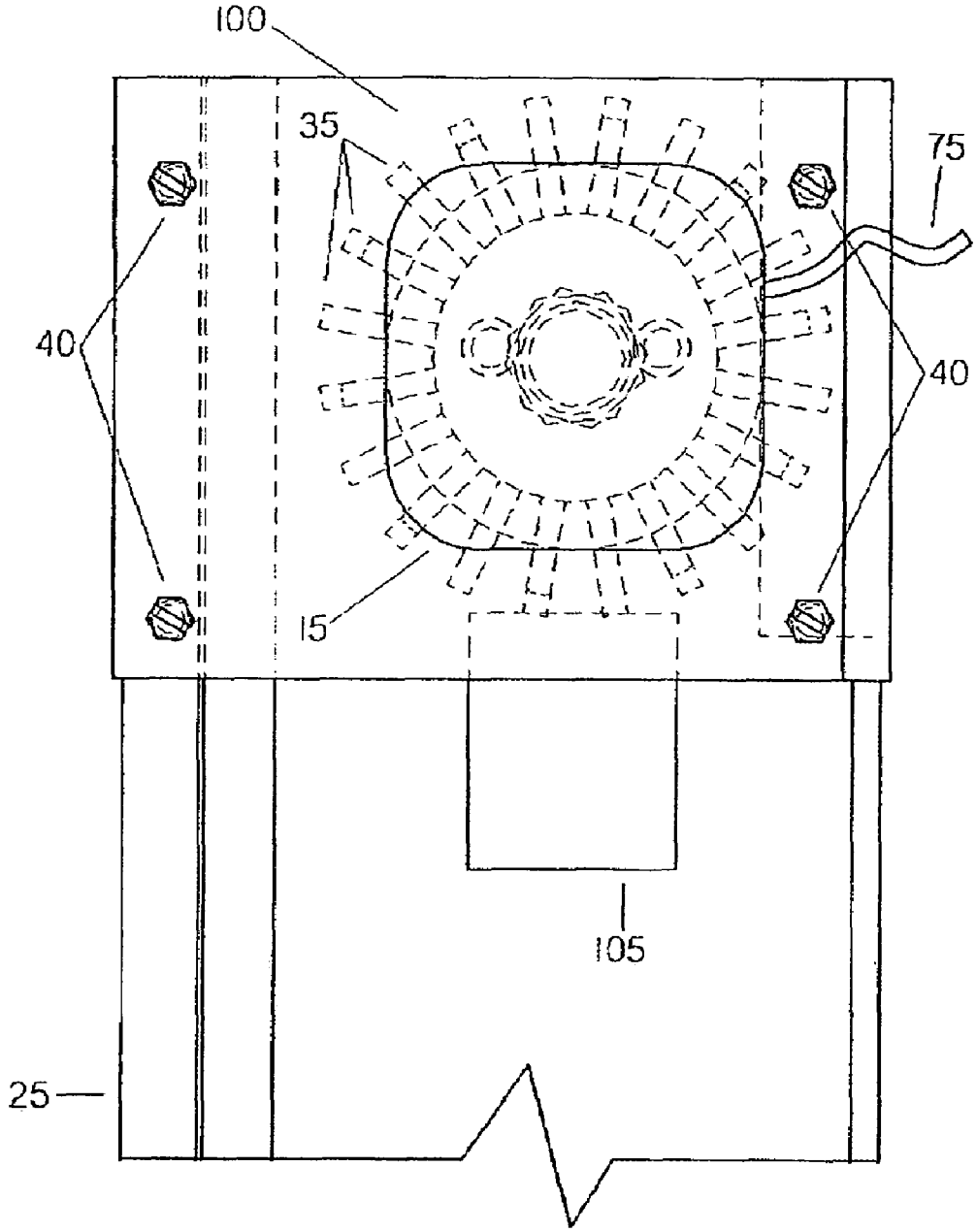
FIG. 5 is a top view of the debris removal apparatus of the present invention.
Figure 6:
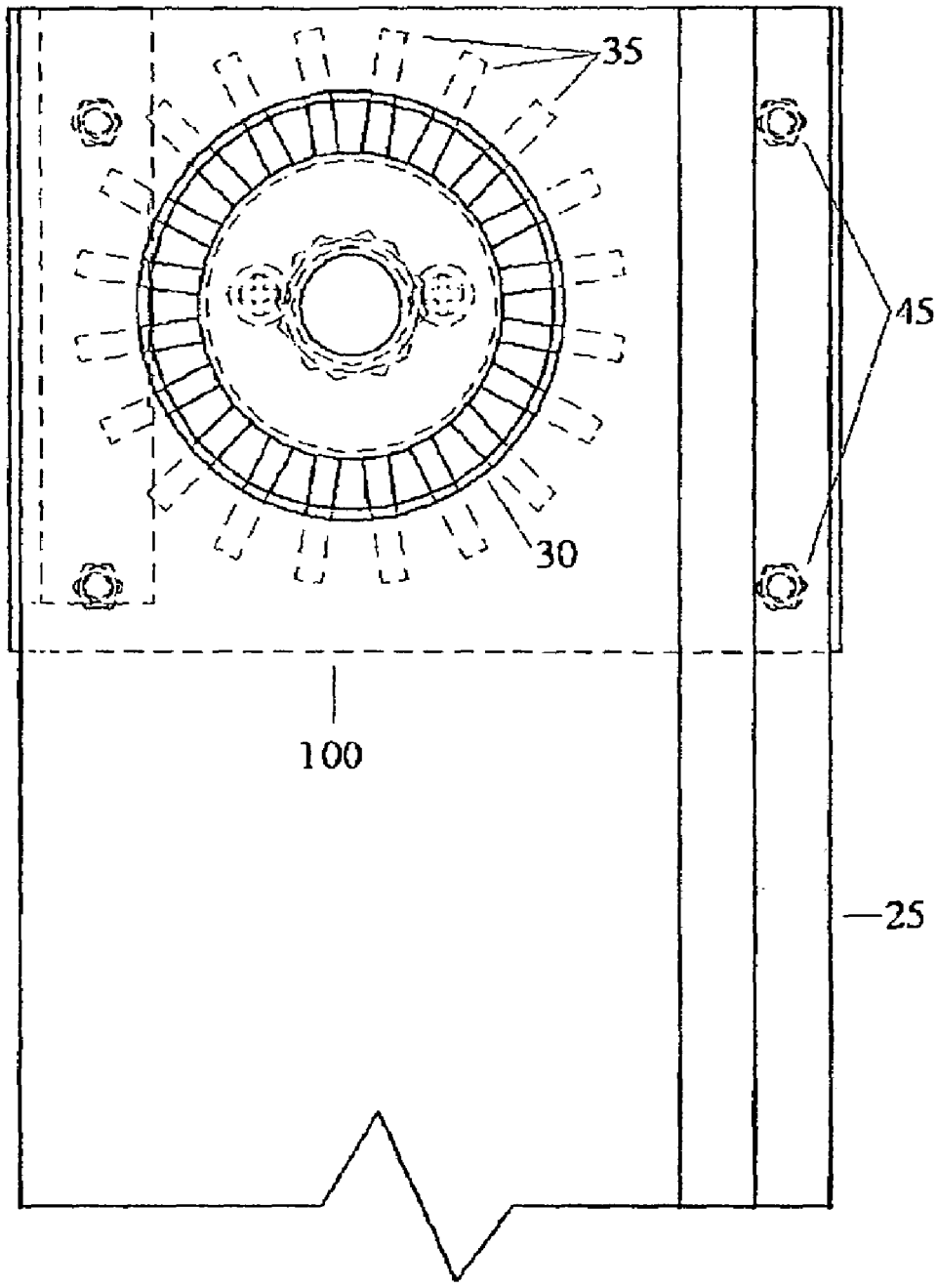
FIG. 6 is a bottom view of the debris removal apparatus of the present invention.
Figure 7:
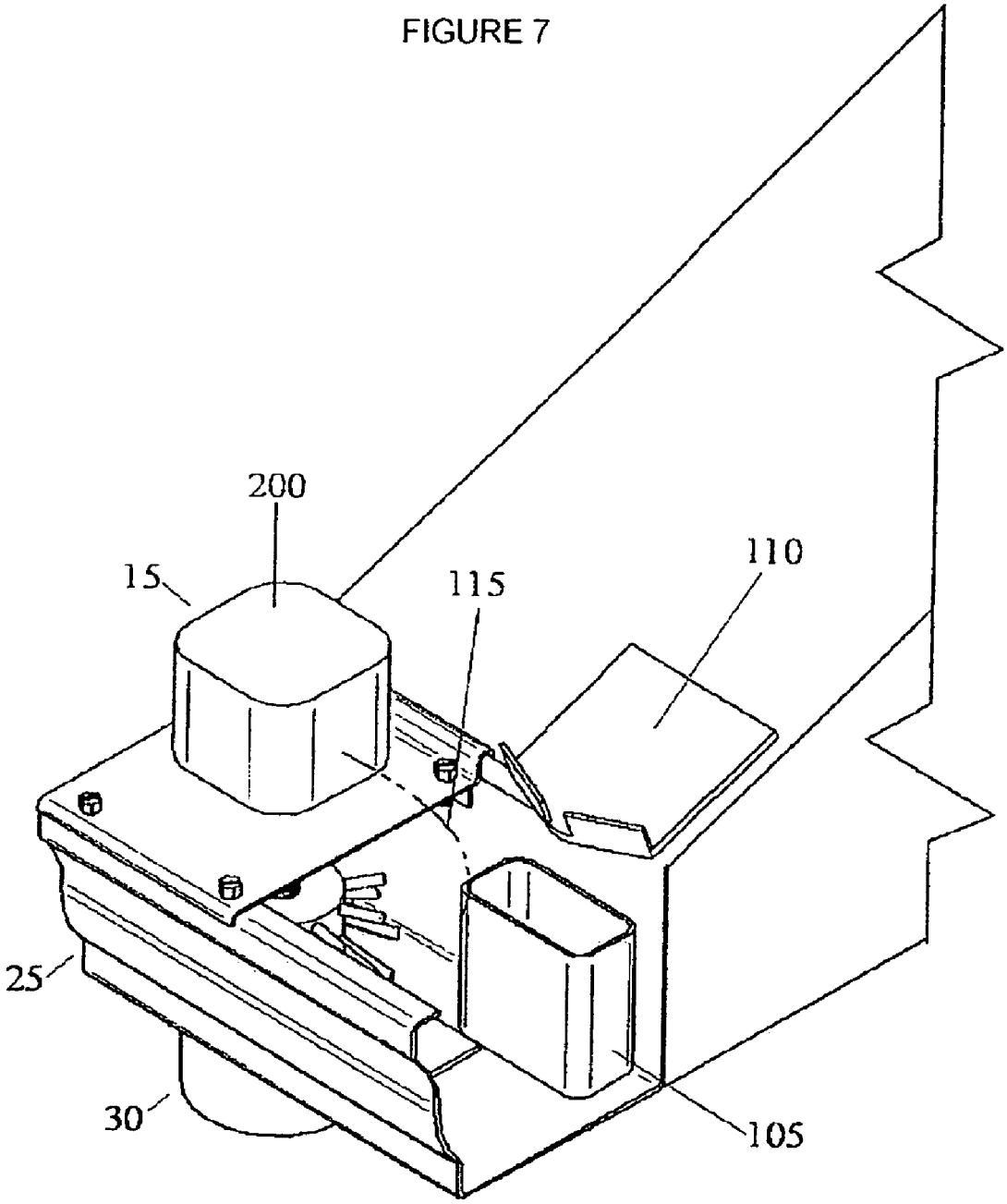
FIG. 7 is a perspective view of the debris removal apparatus with the rain sensor means and protective cover.
Figure 8:
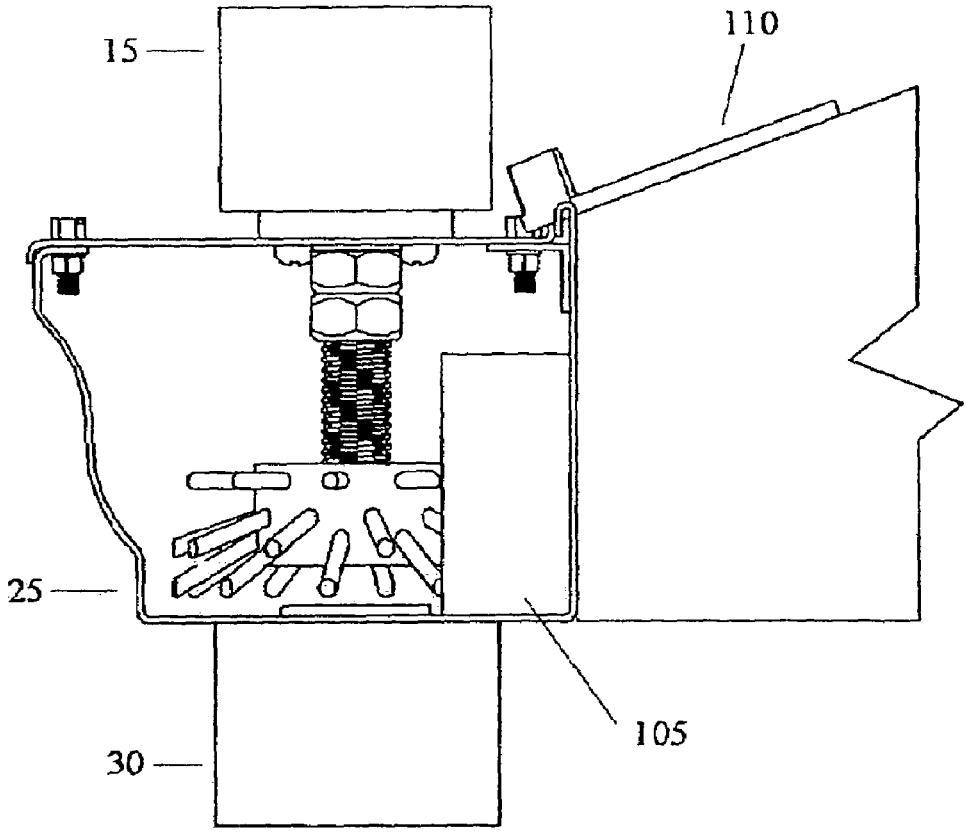
FIG. 8 is a side view of the debris removal apparatus with the rain sensor means.
Figure 9:
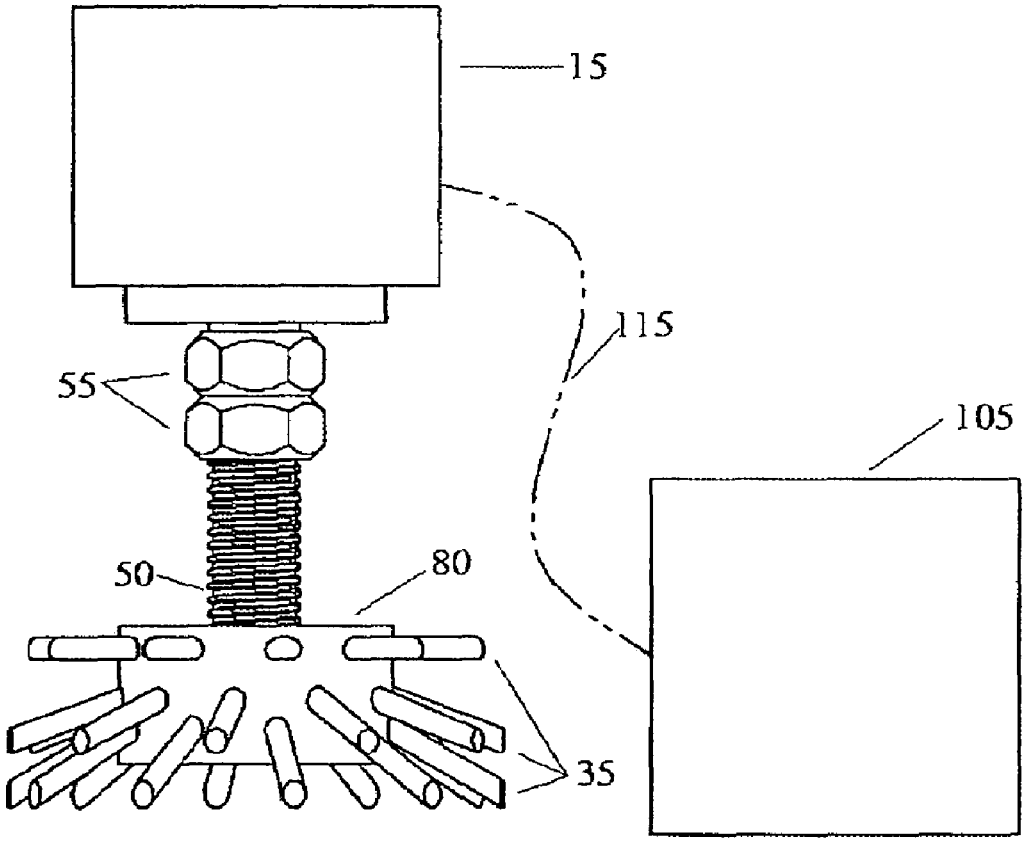
FIG. 9 is a front view of the debris removal apparatus with the rain sensor means outside of a gutter.
Figure 10:
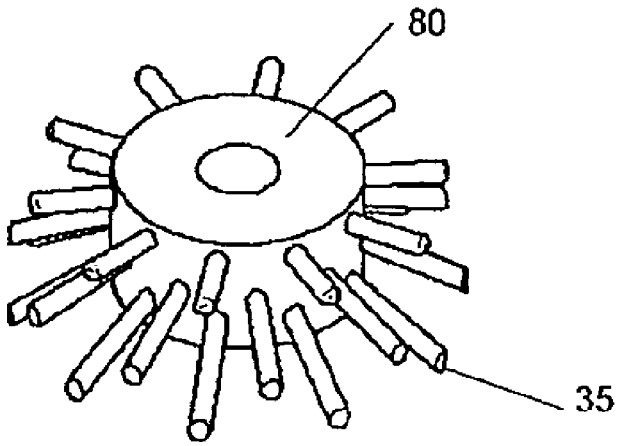
FIG. 10 is another preferred embodiment of the hub and spoke assembly of the present invention.

Optionally, a shaft housing 60 covers the shaft 50 and locking nuts 55 as shown in FIG. 1. Mainly, the shaft housing 60 protects the shaft 50 from deterioration caused by weathering. The debris removal apparatus 10 can be made with or without the shaft housing 60. Further, the shaft housing 60 is optionally removeable.

The power source 15 is mounted on the top side of a mounting plate 100. Optionally, the power source can be mounted anywhere on or near the debris removal apparatus 10. The power source 15 can be energized by electricity (battery or alternating current), solar power, hydroelectric power or other means known in the art. In one embodiment of the present invention, a power cord 75 is optionally attached to the power source 15 (see FIGS. 2 and 5) to provide electric power to the apparatus 10. In this and other embodiments, a manual on/off switch can be optionally associated with power source 15. A solar panel 200 can optionally be situated on the roof, near the roof or on the debris removal apparatus 10 to provide power.

The mounting plate 100 is secured to the gutter 25 by a plurality of pins 40 and attachment nuts 45. In a preferred embodiment, an optional bracket 65 is fastened to the back edge of the gutter 25, which has holes defined therein to accept the pins 40. Further, a bar 95 is optionally attached to the front underside lip of the gutter 25. This bar 95 has holes defined therein to accept the pins 40. Any other means known in the art can be used to attach the mounting plate 100 to the gutter 25, for example, but not limited to, clamps, screws, nails, rivets and/or glue. A shaft hole is defined in the mounting plate 100 for the shaft 50 to be placed therethrough. The debris removal apparatus 10 is mounted over or near a gutter-downspout connection so that the hub 80 is located directly over the downspout 30 opening.

When debris 85 enters the gutter 25 during a rainstorm, the power source 15 drives the shaft 50, causing it to rotate, thus in turn, causing the hub 80 and the plurality of spokes 35 or blades to rotate. This rotation can be in a clockwise or a counterclockwise direction or both. When the spokes 35 or blades rotate, the debris 85 in the gutter 25 is chopped into smaller portions (see FIG. 3) allowing it to be washed down the downspout 30 thereby preventing clogging and/or flooding in the gutter 25.

Figure 14:
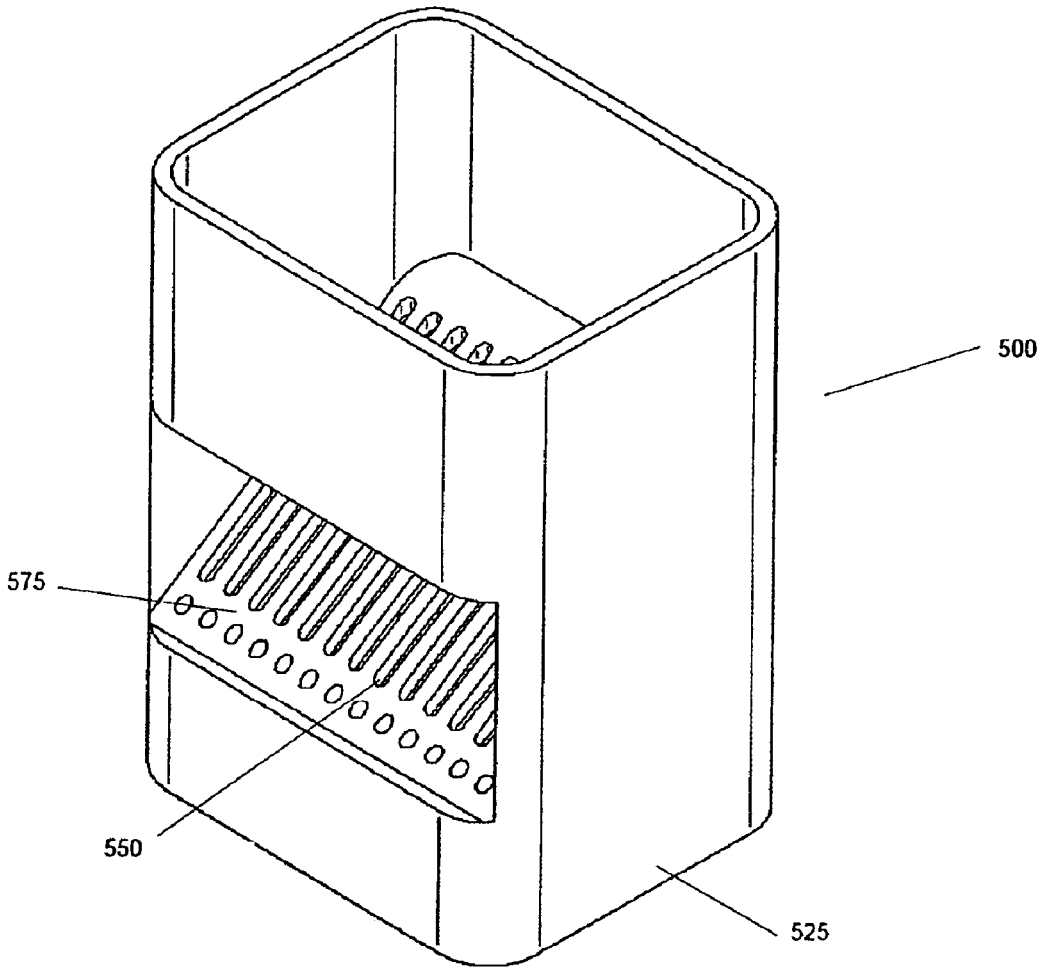
FIG. 14 is the debris deflector of the present invention.
Figure 15:
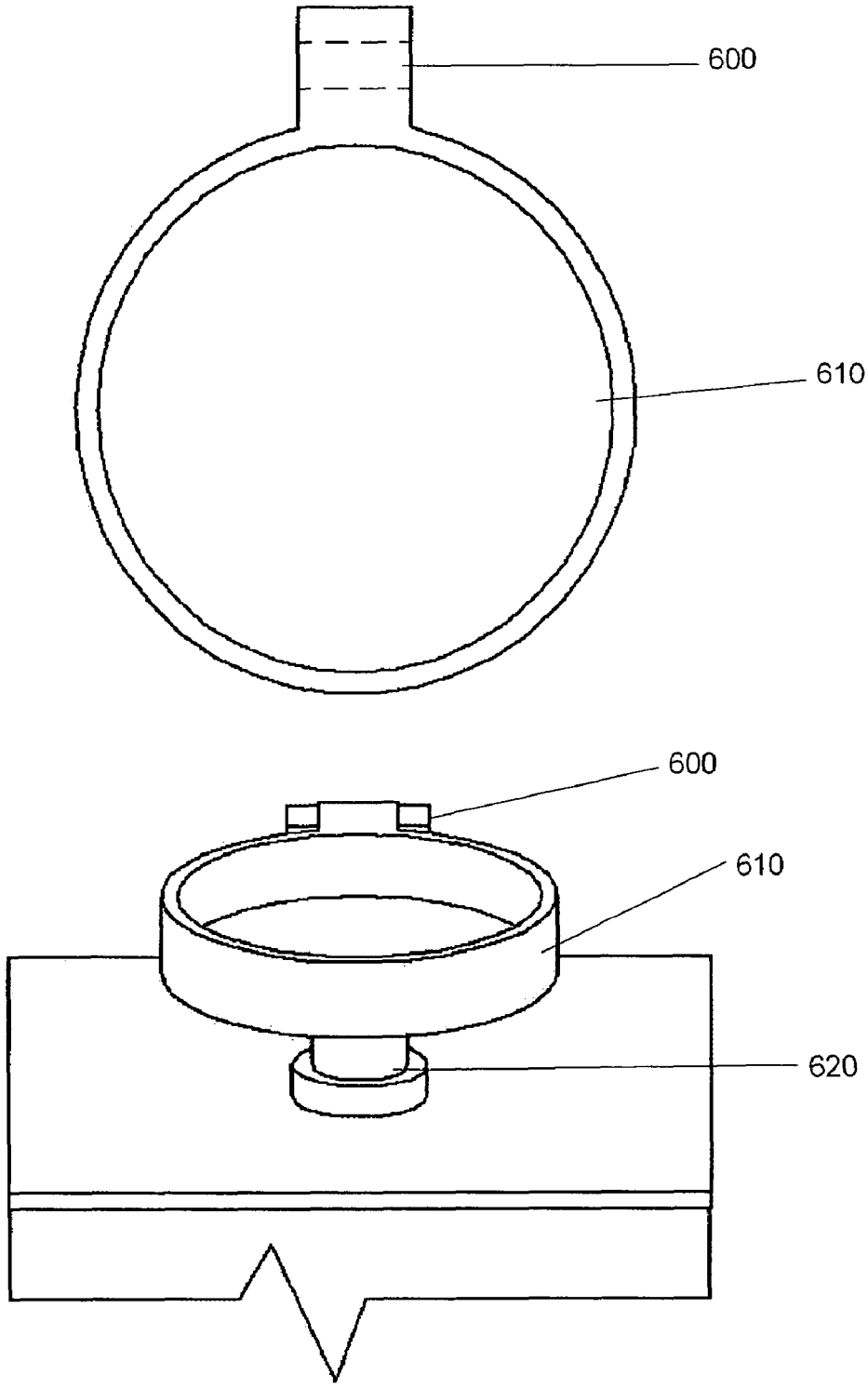
FIG. 15 is a perspective and top view of another version of the rain catcher of the present invention.
Figure 16:
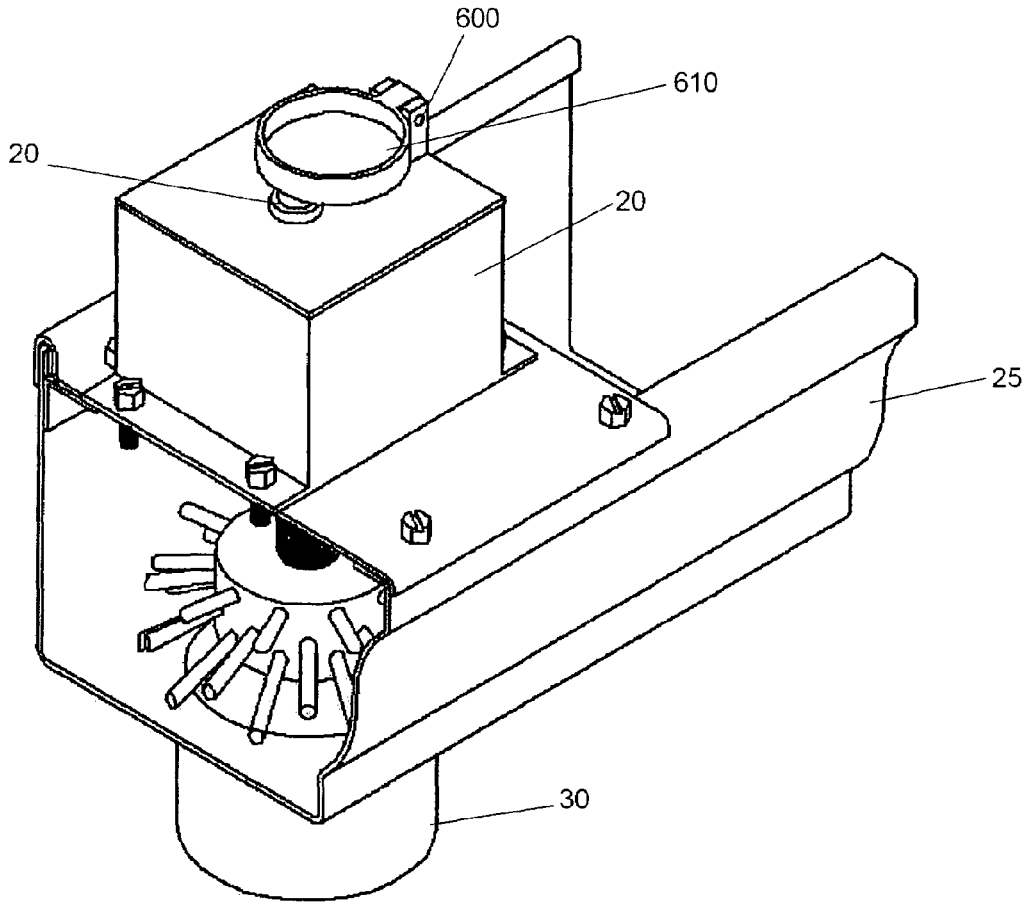
FIG. 16 is a perspective view of another version of the rain catcher of the present invention.

The debris removal apparatus 10 also includes an optional debris deflector 500 which is placed in a downspout 30 near the ground (see FIG. 14). The outer shell 525 fits within a gutter section and/or downspout. As the debris 85 travels down the downspout 30, at least the large pieces of debris 85 are deflected out into the ground by a deflection means 575. The debris 85 can also be removed by hand. This debris deflector 500 prevents the debris 85 from clogging a downspout, sewer or the like. The deflection means 575 has a plurality of slots 550 defined therein. Holes of any shape or size in the deflection means 575 are also within the scope of this invention and could be used instead of slots 550. A screen or mesh embodiment is also within the scope of the present invention. The only requirement for the holes or slots is that they are large enough to allow liquids to pass through the downspout 30 while being small enough to deflect debris 85.

While FIG. 14 demonstrates a flat deflection means 575, which is diagonally situated in the downspout 30, it can also be semicircular, arched or any other shape or direction that will accomplish the purpose of screening large debris 85 from clogging the downspout or sewer while allowing water to penetrate. If heavy debris falls through the downspout 30, a user can reach into the debris deflector 500 and remove the debris himself or herself.

The debris removal apparatus 10 is equipped with an optional rain sensor 105 and a water director 110 in one embodiment. The water director 110 is secured to a portion of the roof (usually by nailing or gluing) near the debris removal apparatus 10. The water director's main function is to channel water to the rain sensor 105. The rain sensor 105 fills with water until it reaches a particular level and then activates the power source 15 of the debris removal apparatus 10 via a connector 115. After the rain sensor 105 activates the debris removal apparatus 10, it empties the water held therein. The connector 115 is optionally an electrical activation device or the like.

The rain sensor's main function is to activate the power source 15 of the debris removal apparatus 10 during rainstorms so that when debris 85 is washed into the gutter 25, the debris removal apparatus 10 can chop up the debris 85 and allow it to flow through the downspout 30, thereby preventing flooding and clogging in the gutter 25. The rain sensor 105 also functions to prevent the debris removal apparatus 10 from being constantly "on" or even being connected to a timer. This rain sensor 105 allows the apparatus 10 to only activate during rainstorms, when debris removal is needed.

In another various embodiment of the rain sensor or rain catcher 610 (see FIGS. 15 and 16) of the present invention, a liquid retaining plate is pivotably mounted on a hinge 600. This hinge 600, in one various embodiment, is mounted to the top of the cover 20. The liquid retaining plate extends over an activation button 620 optionally located near or on the top cover 20. The liquid retaining plate is adapted to collect liquid, preferably rain water. The weight of the liquid in the retaining plate causes activation button 620 to become depressed because of the downward force caused by gravity and the weight of the liquid. When the activation button 620 is depressed, it activates the debris removal apparatus 10. Optionally, the apparatus can run for any length of time upon activation. Further, the moisture retaining plate can optionally drain the moisture within it upon activation.

This various embodiment of the rain sensor 610 can be mounted anywhere on or near the apparatus 10 as long it can signal the debris removal apparatus 10 and activate it.

In other various embodiments, the rain sensor 105 and water director 110 are eliminated. The power source is either always "on" or run by a timer, which activates it sporadically.

Optionally, a cover 20 (see FIG. 1) can be mounted over the power source 15 to prevent natural elements from causing damage to the debris removal apparatus 10. The apparatus 10 is not limited to an embodiment with the cover 20. The debris removal apparatus 10 can function properly with or without the cover 20.

Also disclosed is a method of using a debris removal apparatus 10 in a gutter 25 of a structure comprising the steps of mounting a debris removal apparatus 10 in a gutter directly above a downspout 30 opening, activating a power source 15, during rain storms, by using a rain sensor 105 or rain catcher of the debris removal apparatus 10, rotating the shaft 50 and in turn the hub 80 and spokes 35 or blades in a clockwise or counterclockwise direction or both, via the power source 15, and chopping large debris in a gutter 25 by means of spoke 35 or blade rotation to provide debris-less gutters on a structure. Further optionally comprising the step of, preventing debris 85 from clogging the downspout or sewer through the use of a debris deflector 500.

I claim:

1. A debris removal apparatus for use in a gutter comprising:

a mounting plate attached to said gutter, having a hole defined therein;

a power source attached to a top of said mounting plate;

a shaft having a first end and a second end, wherein said shaft is attached to said power source at said first end, and wherein said shaft extends through said hole defined in said mounting plate;

a hub attached to said second end of said shaft, said hub having a plurality of spokes extending therefrom; and an activation device capable of activating and deactivating the power source, wherein the activation device is selected from the group consisting of:

a rain sensor and a water director which in conjunction activate said power source during rain storms and a rain catcher having a liquid retaining plate, a hinge and an activation button to activate said power source during rain storms;

whereby said apparatus is mounted on said gutter and is configured such that the hub is located directly over a downspout opening and wherein said apparatus removes debris from said gutter to prevent clogging and flooding.

2. The apparatus of claim 1, wherein said shaft is threaded.

3. The apparatus of claim 2, wherein at least one locking nut is situated on said shaft below said mounting plate to provide support to said debris removal apparatus.

4. The apparatus of claim 1, wherein said spokes are of varying length and extend outwardly and downwardly from said hub.

5. The apparatus of claim 1, further comprising a bracket and a bar, each with holes defined therein for accepting pins, for attaching said mounting plate to said gutter.

6. The apparatus of claim 1, further comprising a cover situated over said debris removal apparatus to protect from weathering.

7. The apparatus of claim 1, further comprising a power cord to provide electricity to said power source.

8. The apparatus of claim 1, further comprising a solar panel to provide solar power to said power source.

9. The apparatus of claim 1, further comprising a debris deflector, situated in a downspout, having deflection means to prevent clogging in said downspout.

10. The apparatus of claim 1, further comprising a plurality of blades extending therefrom in additional to said plurality of spokes.

11. A debris removal apparatus for use in a gutter comprising:

a power source;

a shaft, having a first end and a second end, wherein said shaft is attached to said power source at said first end;

a hub attached to said second end of said shaft, said hub having a plurality of varying length spokes and blades extending therefrom, said debris removal apparatus mounted on said gutter so that the hub is located directly over a downspout opening; and an activation device capable of activating and deactivating the power source, wherein the activation device is selected from the group consisting of:

a rain sensor and a water director which in conjunction activate said power source during rain storms and a rain catcher having a liquid retaining plate, a hinge and an activation button to activate said power source during rain storms:

whereby said apparatus removes debris from said gutter to prevent clogging and flooding.

12. The apparatus of claim 11, wherein said shaft is threaded.

13. The apparatus of claim 11, further comprising a mounting plate attached to said gutter, wherein said mounting plate has a hole defined therein to accept said shaft.

14. The apparatus of claim 11, further comprising a bracket and a bar for attaching said mounting plate to said gutter.

15. The apparatus of claim 11, further comprising a power cord to provide electricity to said power source.

16. The apparatus of claim 11, further comprising a solar panel to provide solar power to said power source.

17. A method of debris removal in a gutter comprising the steps of:

mounting a debris removal apparatus in a gutter near a downspout opening so that a hub is located directly over the downspout opening;

using a power source to rotate a shaft and in turn said hub and a plurality of spokes wherein the power source is activated by an activation device selected from the group consisting of:

a rain sensor and a water director which in conjunction activate said power source during rain storms and a rain catcher having a liquid retaining plate, a hinge and an activation button to activate said power source during rain storms; and, chopping debris in said gutter using said spokes to provide debris-less gutters on a structure and prevent clogging.

18. The method of claim 17, wherein said mounting is accomplished through the use of a bar, a bracket, pins and attachment nuts.

19. The method of claim 17, further comprising the step of preventing debris from clogging a downspout or sewer by situating a debris deflector in said downspout.

* * * * *